US006095251A

United States Patent [19]

Mitchell et al.

[11] Patent Number: 6,095,251

[45] Date of Patent: Aug. 1, 2000

[54] DUAL STAGE FIRE EXTINGUISHER

[75] Inventors: Robert M. Mitchell, Issaquah; Paul H. Wierenga, Seattle; Randel L. Hoskins, Bothell, all of Wash.

[73] Assignee: Primex Technologies, Inc., Redmond, Wash.

[21] Appl. No.: 09/115,190

[22] Filed: Jul. 14, 1998

Related U.S. Application Data

[63] Continuation-in-part of application No. 09/034,711, Mar. 4, 1998.

[60] Provisional application No. 60/053,365, Jul. 22, 1997.

[51] Int. Cl.[7] ..... A62C 2/00

[52] U.S. Cl. ..... 169/43; 169/26; 169/44; 169/45; 169/46; 169/54; 169/62

[58] Field of Search ..... 169/5, 26, 43, 169/44, 45, 46, 54, 62

[56] References Cited

U.S. PATENT DOCUMENTS

| | | | |
|---|---|---|---|
| 2,015,995 | 10/1935 | Egtvedt | 169/62 X |
| 3,356,148 | 12/1967 | Jamison | 169/44 X |
| 3,388,746 | 6/1968 | Linderberg | 169/62 X |
| 3,584,688 | 6/1971 | Duncan et al. | 169/26 X |
| 5,188,257 | 2/1993 | Plester | 169/44 X |
| 5,393,438 | 2/1995 | Fernandez | 169/46 X |
| 5,449,041 | 9/1995 | Galbraith | 169/26 X |
| 5,909,776 | 6/1999 | Stewart et al. | 169/26 |

*Primary Examiner*—Andres Kashnikow
*Assistant Examiner*—Robin O. Evans
*Attorney, Agent, or Firm*—Wiggin & Dana; Gregory S. Rosenblatt

[57] ABSTRACT

A fire is extinguished and suppressed, by a dual stage fire extinguisher. In a first stage, a sufficient amount of an inerting agent is delivered to extinguish the fire. Once the fire is extinguished, in the second stage, a different amount of inerting agent is delivered to the fire to prevent its re-ignition. Since suppression typically requires less of the inerting agent than extinguishing, a reduction in the weight of the inerting agent is achieved with the dual stage process making the system particularly amenable to aircraft applications such as in an engine nacelle or cargo dry bay.

19 Claims, 12 Drawing Sheets

DUAL STAGE FIRE EXTINGUISHER

CROSS-REFERENCE TO RELATED APPLICATIONS

This is a continuation-in-part of U.S. patent application Ser. No. 09/034,711, filed Mar. 4, 1998, which claims priority to U.S. Provisional Patent Application Ser. No. 60/053,365, filed Jul. 22, 1997.

BACKGROUND OF THE INVENTION

1. Field of the Invention

This invention relates to a method for extinguishing a fire and preventing re-ignition. More particular, a fire extinguishing agent is discharged at a first mass flow rate to extinguish the fire followed by discharge at a second mass flow rate that is effective to prevent re-ignition of the fire.

2. Description of Related Art

Fire involves a chemical reaction between oxygen and a fuel that is raised to its ignition temperature by heat. Fire suppression systems operate by any one or a combination of the following: (i) removing oxygen, (ii) reducing the system temperature, (iii) separating the fuel from oxygen, and (iv) interrupting the chemical reactions of combustion. Typical fire suppression agents include water, carbon dioxide, dry chemicals, perfluorocarbons (PFC's), hydrofluorocarbons (HFC's) and the group of halo-carbons collectively known as Halons.

The most efficient fire suppression agents are Halons. Halons are a class of brominated fluorocarbons and are derived from saturated hydrocarbons, such as methane or ethane, with their hydrogen atoms replaced with atoms of the halogen elements bromine, chlorine and/or fluorine. The most widely used Halon is Halon 1301, $CF_3Br$, trifluorobromomethane. Halon 1301 extinguishes a fire in concentrations far below the concentrations required for carbon dioxide or nitrogen gas. Typically, a Halon 1301 concentration above about 3.3% by volume will extinguish a fire.

Halon fire suppression occurs through a combination of effects, including decreasing the available oxygen, isolation of fuel from atmospheric oxygen, cooling and chemical interruption of the combustion reactions. The superior fire suppression efficiency of Halon 1301 is due to its ability to terminate the runaway reaction associated with combustion. The termination step is catalytic for Halon 1301 due to the stability of bromine radicals (Br●) formed when Halon 1301 is disposed on a combustion source.

When unreacted Halon 1301 migrates into the stratosphere, sunlight breaks down the Halon 1301 forming bromine radicals which react to consume ozone in an irreversible manner:

$$Br\bullet + O_3 \rightarrow Br\bullet + O_2$$

In view of the current recognition that ozone depletion is a serious environmental problem, a move is on to: (i) identify fire suppression agents having a less severe environmental impact than Halon; and (ii) develop devices to deliver these more environmentally friendly agents.

Most agents identified as replacements for Halon 1301 are not as efficient extinguishants. Typically, these replacement agents require between two and three times the volume as compared to Halon 1301. The excess volume creates a retrofit problem when space is at a premium.

In addition to extinguishing the fire, it is necessary to suppress the fire as well. Suppression insures that the fire does not re-ignite and requires an inerting agent to remain in contact with the location of the extinguished fire for a time sufficient to either (1) reduce the system temperature below the temperature necessary to support combustion, (2) remove the fuel source, or (3) separate the fuel from the oxygen.

A fire suppression apparatus is frequently located in an aircraft engine nacelle, the aerodynamic structure surrounding the engine. An annular region between the engine and the nacelle presents a fire hazard. During flight, all the requirements of a fire—fuel, oxygen and heat—are present in the nacelle. Some aircraft engine components operate at elevated temperatures, in excess of 700° F. (370° C.), and are thus capable of igniting fuel. An airflow containing oxygen is routed through the annular region to cool the engine. Fuel and hydraulic fluids are supplied to the engine in lines that extend through the region and can leak. In combat, military aircraft can be exposed to unfriendly fire that can sever fuel or hydraulic lines as can other mechanical failures or damage.

Therefore, most commercial and military aircraft utilize an on-board engine nacelle fire detection and extinguishing/suppression system.

Conventionally, when a fire occurs in an engine nacelle, the pilot performs two tasks to save the aircraft: (1) fuel to the engine is shut off; and (2) an on-board fire extinguisher is activated discharging an agent into the nacelle. In some aircraft, the fuel is automatically shut off to the engine in question when the extinguisher is discharged. Generally, several seconds are required to de-pressurize or bleed the fuel lines, during which interval, they may continue to deliver fuel to the fire.

After the nacelle fire is extinguished, re-ignition must be prevented. Preventing an extinguished fire from re-igniting is called suppression. If the re-ignition source is a component operating at an elevated temperature, the suppression time is dependent on how long it takes to bleed the fuel out of the lines. If the re-ignition source is a surface heated by the fire, then the suppression time is dependent on the time it takes the air flow to cool the surface below the ignition temperature (if less than the time required to bleed the fuel line). In either instance, generally from about six to seven seconds are required to inert a fire, extinguish it, and suppress its re-ignition. Therefore, the inerting agent must be able to extinguish the fire and keep it out for a predetermined time, which is typically aircraft-specific.

When used as an inerting agent, Halon 1301 is discharged from a pressurized bottle. The bottle containing the Halon 1301 is supercharged with nitrogen to a predetermined pressure. When activated, the agent is discharged by a blowdown mode and routed to the nacelle via tubing. It is necessary to maintain a minimum concentration of 3.3%, by volume, of Halon 1301 over the entire time required to extinguish and suppress re-ignition of the fire. To compensate for the dissipation of inerting agent, in a conventional fire extinguisher the concentration of inerting agent is initially brought up to a level significantly higher than 3.3% to insure that an effective concentration will remain for suppression. The inventors have observed that this excess amount of inerting agent is not required to fight the fire and represents a significant penalty as to cost, weight and environmental impact.

There remains, therefore, a need for a system to economically inert a fire that does not suffer from the disadvantages of the prior art.

SUMMARY OF THE INVENTION

Accordingly, it is an object of the invention to provide a method to efficiently inert a fire. It is a feature of the invention that an inerting media is delivered in two stages. In a first stage, a mass flow rate effective to extinguish the fire is employed. In a second stage, the inerting medium is delivered at a different mass flow rate that is effective to suppress re-ignition of the fire.

Among the advantages of the method of the invention are that a minimum quantity of inerting media for a given fire situation is employed. This reduces the cost and the weight of the fire suppression system and, in the instance of Halons and other environmentally destructive media, reduces the environmental impact. Another advantage of the invention is that the dual stage process is amenable to many types of fire suppression systems and requires minimal retrofitting of existing equipment.

In accordance with the invention, there is provided a method to inert a fire. The method includes delivering a first inerting agent to the fire. A second inerting agent is then delivered to location of the extinguished fire at a second mass flow rate for a time effective to prevent re-ignition.

A system according to the invention may advantageously be configured to be used in an application formerly served by a prior art system. This may include a retrofit use such as to replace an existing system in an existing aircraft. Relative to the replaced system, the replacement system may have any or all of the following attributes:

a) The amount (either as an absolute percentage or a relative percentage) by which the peak concentration of inerting agent exceeds a required concentration will be lower in the replacement system. This may apply if the inerting agent in the replacement system is the same as or different from the inerting agent in the replaced system.

b) If the inerting agents are the same in the replacement and replaced system (and thus the required concentration of agent in the system is the same), the specific peak concentration in the replacement system will be lower.

c) The amount of agent actually expended during the interval necessary to extinguish and suppress re-ignition of the fire will be relatively closer to the minimum required amount in the replacement system as compared with the replaced system. The total effective amount of inerting agent (mass multiplied by the efficiency of the particular agent) in the replacement system will be less than that in the replaced system.

d) A relatively less efficient but more environmentally-safe inerting agent may be used in the replacement system.

e) The expulsion of inerting agent will occur over a longer interval of time in the replacement system preferably approximately co-extensive with the predicted (including margin of error) interval necessary to extinguish and suppress re-ignition of the fire.

The above stated objects, features and advantages will become more apparent from the specification and drawings that follow.

DETAILED DESCRIPTION

Figure 1:
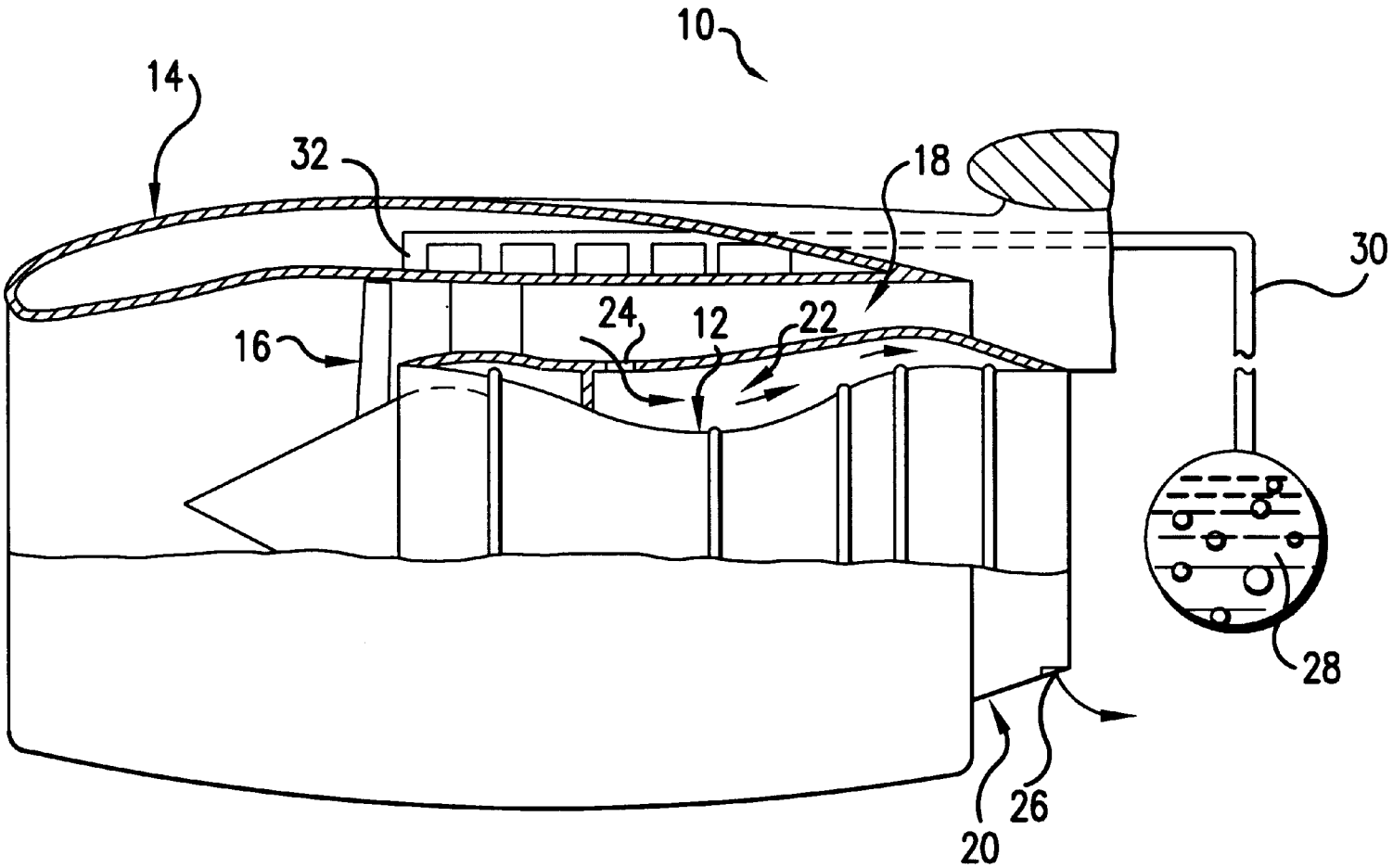
FIG. 1 illustrates in partial breakaway view, an aircraft engine containing a fire suppression system.

FIG. 1 illustrates an aircraft engine 10 including a core engine 12 supported by a fan nacelle 14 as illustrated in U.S. Pat. No. 5,239,817 to Mildenstein et al. The aircraft engine 10 is a fan jet type and includes rotating fan blades 16. A fan discharge 18 is in annular passageway extending between an inner surface of the nacelle 14 and an outer surface of the core engine nacelle 20. A core compartment 22 is defined as the space between the inner surface of the core engine nacelle 20 and the outer surface of the core engine 12. An inlet 24 introduces cooling air through the engine compartment that exits through an outlet 26.

The engine 10 operates at elevated temperature and has a ready supply of oxygen, through the cooling air. Therefore, if jet fuel or flammable hydraulic liquids are discharged between the nacelle and the engine, a fire is a definite possibility. To extinguish the fire, an inerting agent 28 housed remotely from the engine 10 is delivered to the engine through conduit 30. Usually, conduit 30 ends at a plurality of discharge ports 32 disposed axially and circumferentially around the core engine 12.

Figure 2:
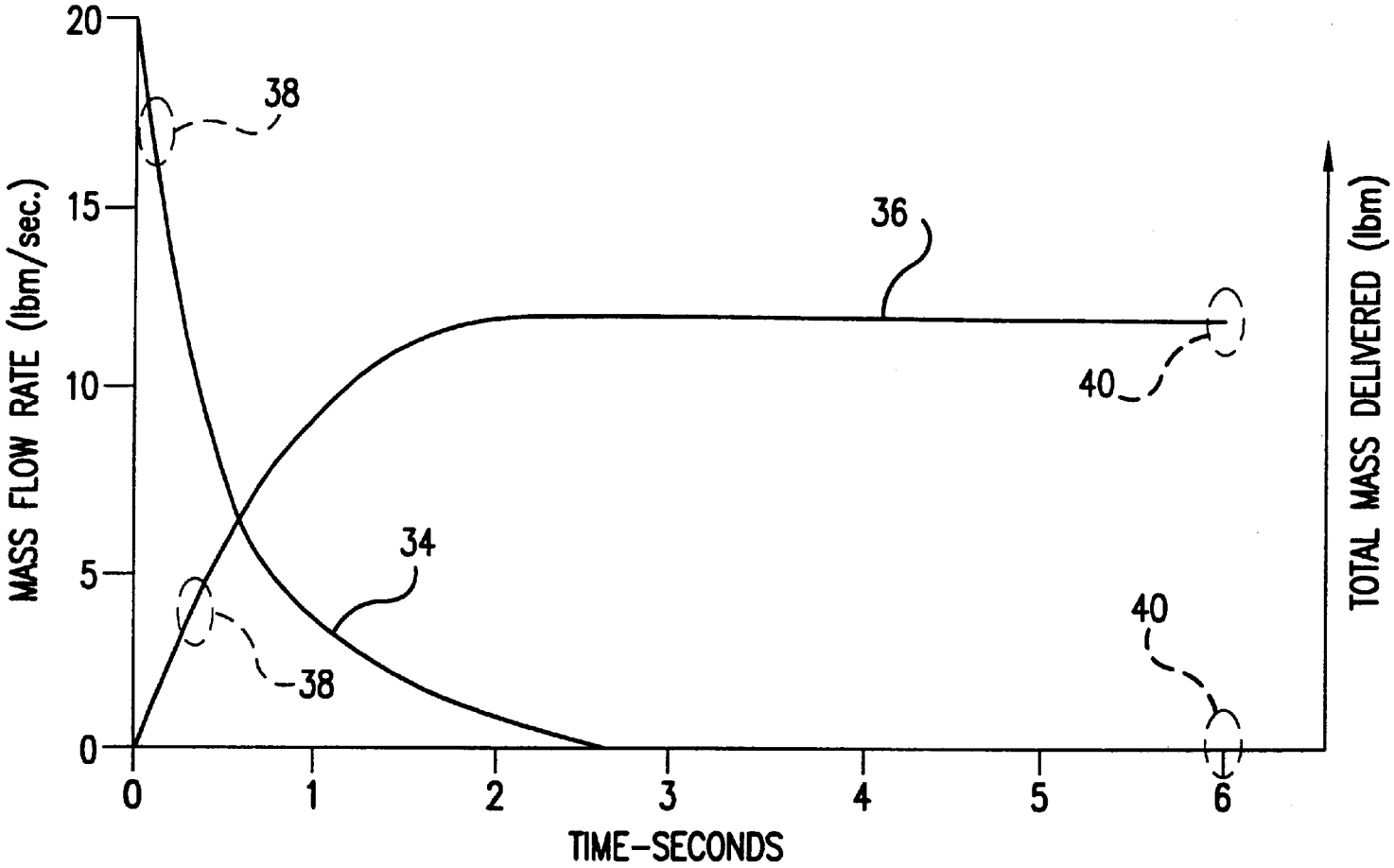
FIG.2 PRIOR ART
FIG. 2 graphically illustrates the mass flow rate of Halon 1301 as a function of time when utilized according to prior art methods.
Figure 3:
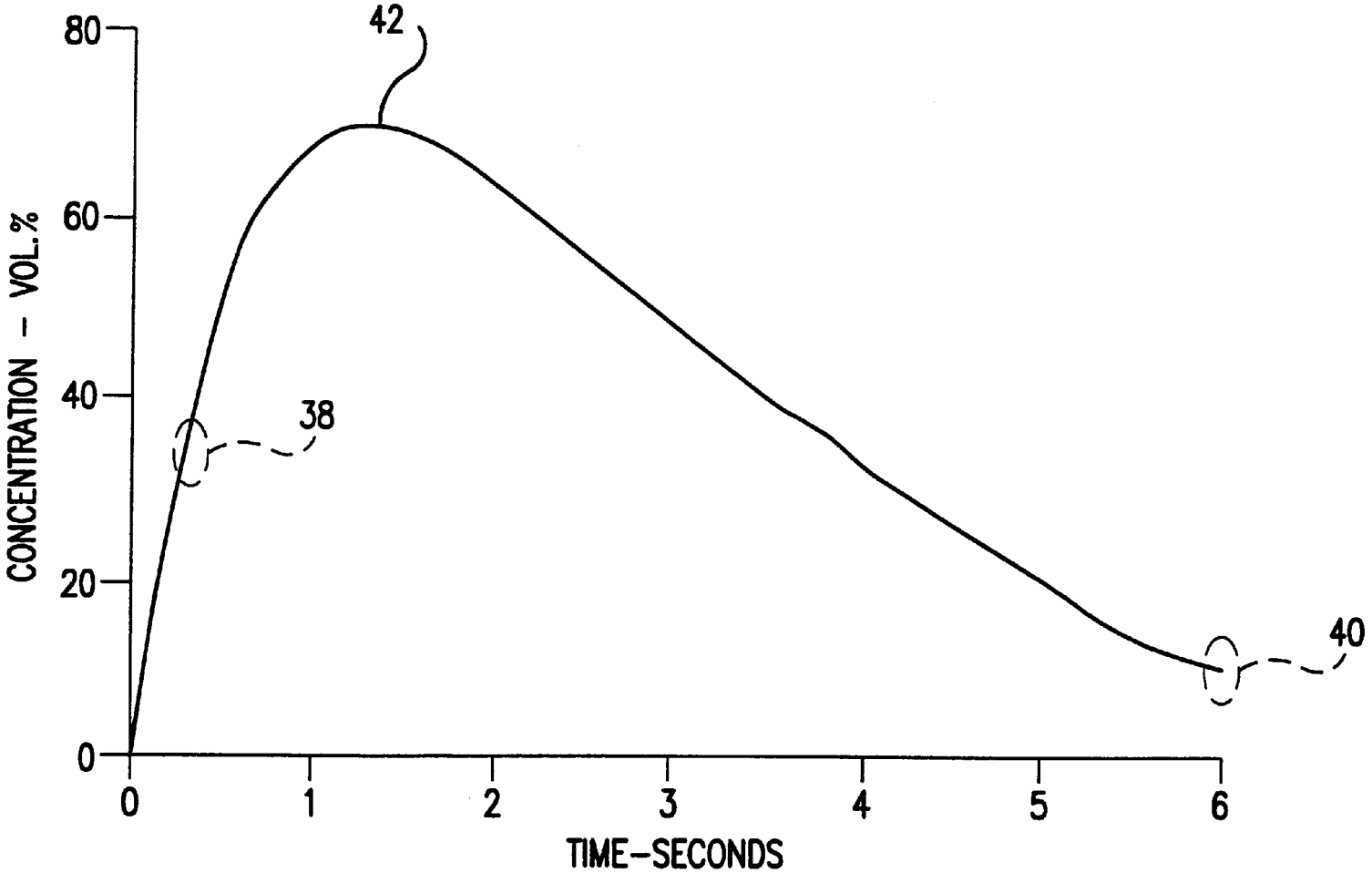
FIG.3 PRIOR ART
FIG. 3 graphically illustrates the concentration, in volume percent, of Halon 1301 when utilized according to the method of the prior art.

FIGS. 2 and 3 graphically illustrate discharge characteristics typical for a pressurized liquid inerting agent, such as Halon 1301. Reference line 34 is the agent mass flow rate and illustrates the delivery rate of the inerting agent in pounds-mass per second. Reference line 36 illustrates the total amount of inerting agent delivered to the fire in pounds. Region 38 identifies when the fire is extinguished and region 40 identifies when the fire is suppressed to a point at which it will not re-ignite in the absence of the agent. The time between region 38 and region 40 identifies the interval during which the fire must be suppressed to prevent re-ignition.

FIG. 3 graphically illustrates the concentration, in volume percent, of inerting agent. A minimum concentration of inerting agent, 3.3% by volume for Halon 1301, is required to suppress the fire up to region 40 and to prevent re-ignition. Since the inerting agent dissipates with time, a maximum concentration 42, well in excess of the minimum concentration required to extinguish the fire at region 38 is provided.

This excess concentration, while necessary to insure suppression, is not required to inert the fire and may be eliminated by the method of the invention.

Figure 4:
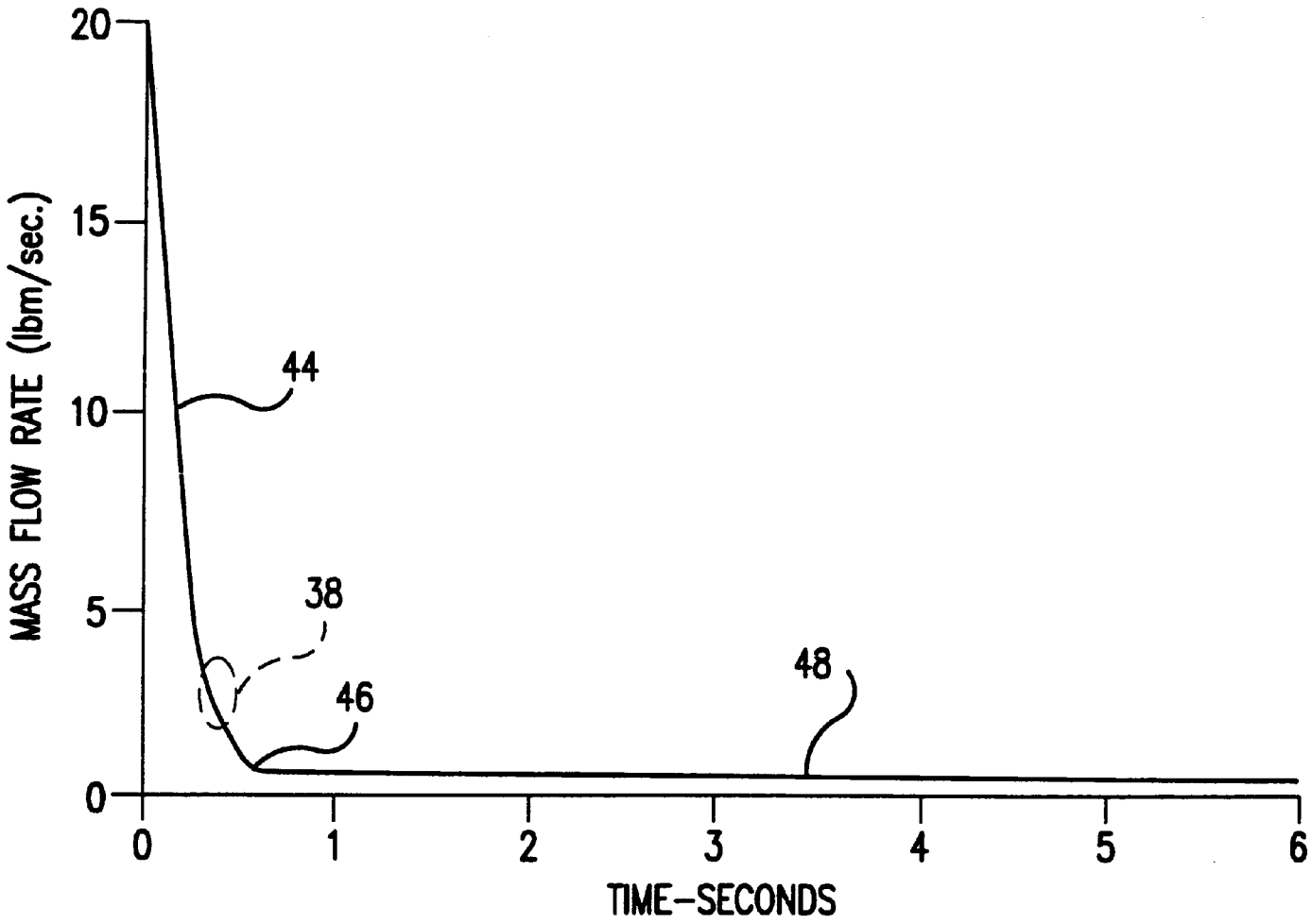
FIG. 4 illustrates the mass flow rate of an inerting medium in accordance with the invention.

FIG. 4 graphically illustrates the mass flow rate of an inerting agent for a dual stage fire extinguisher in accordance with the invention. In a first stage 44, the inerting agent is discharged at a first rate that is effective to extinguish a fire as indicated by region 38. Subsequent to extinguishing the fire, the mass flow rate undergoes a transition 46 to a second mass flow rate 48 that is sufficient to suppress the fire.

Figure 5:
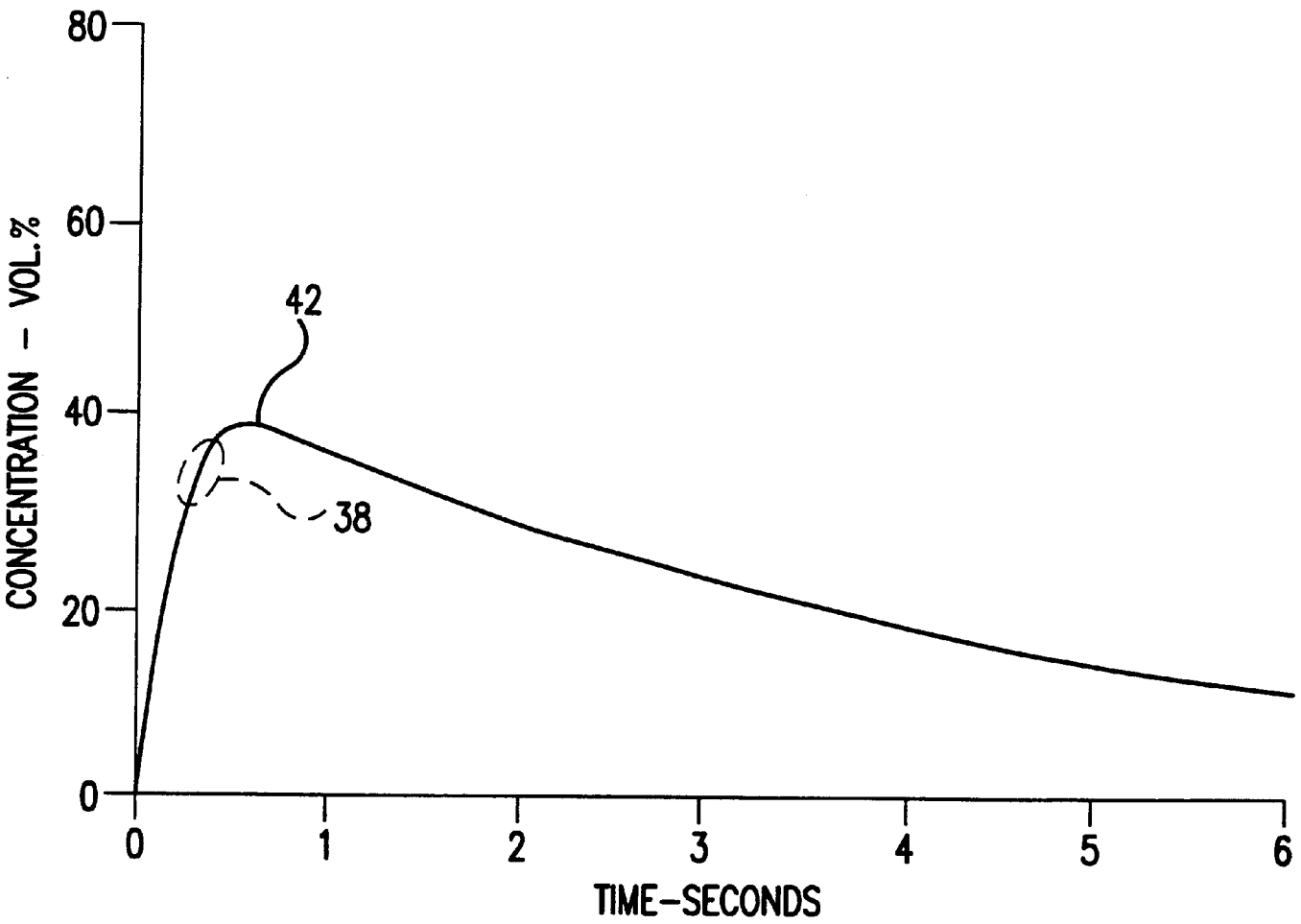
FIG. 5 illustrates the concentration, in volume percent, of the inerting medium in accordance with the method of the invention.

As illustrated in FIG. 5, the volume concentration achieves a maximum 42 only slightly above the extinguishing region 38 and then remains sufficiently high to prevent the fire from re-igniting.

Figure 6:
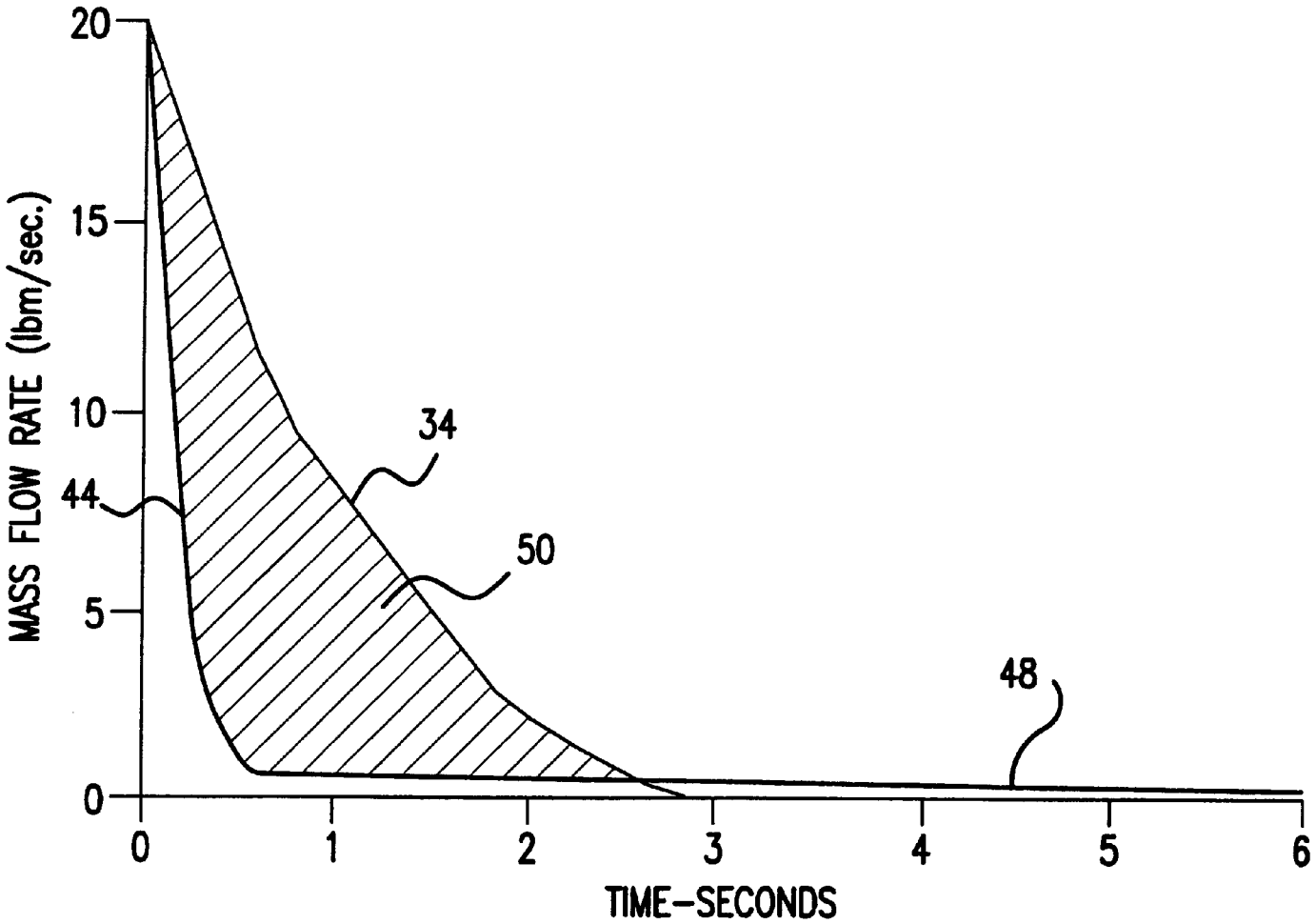
FIG. 6 illustrates the mass flow rate improvement achieved by the method of the invention.
Figure 7:
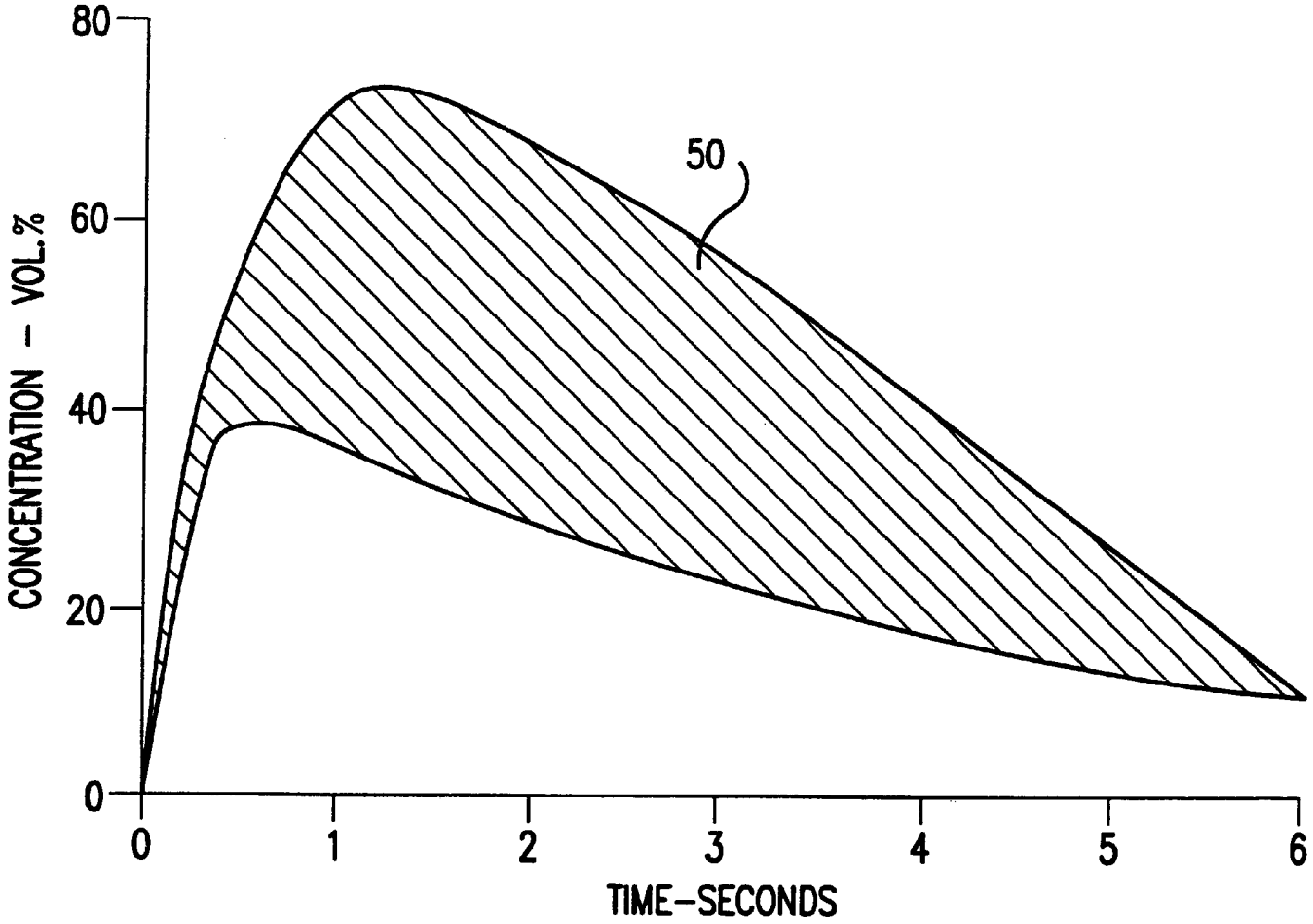
FIG. 7 illustrates the concentration in volume percentage improvement achieved by the method of the invention.

FIGS. 6 and 7 illustrate the savings by the dual stage process of the invention. In FIGS. 6 and 7, the mass flow rate and volume concentrations from a single stage fire extinguisher as known from the prior art is superimposed over the dual stage graphs of FIGS. 4 and 5. The cross-hatched region 50 represents a savings in the amount of inerting material required.

Figure 8:
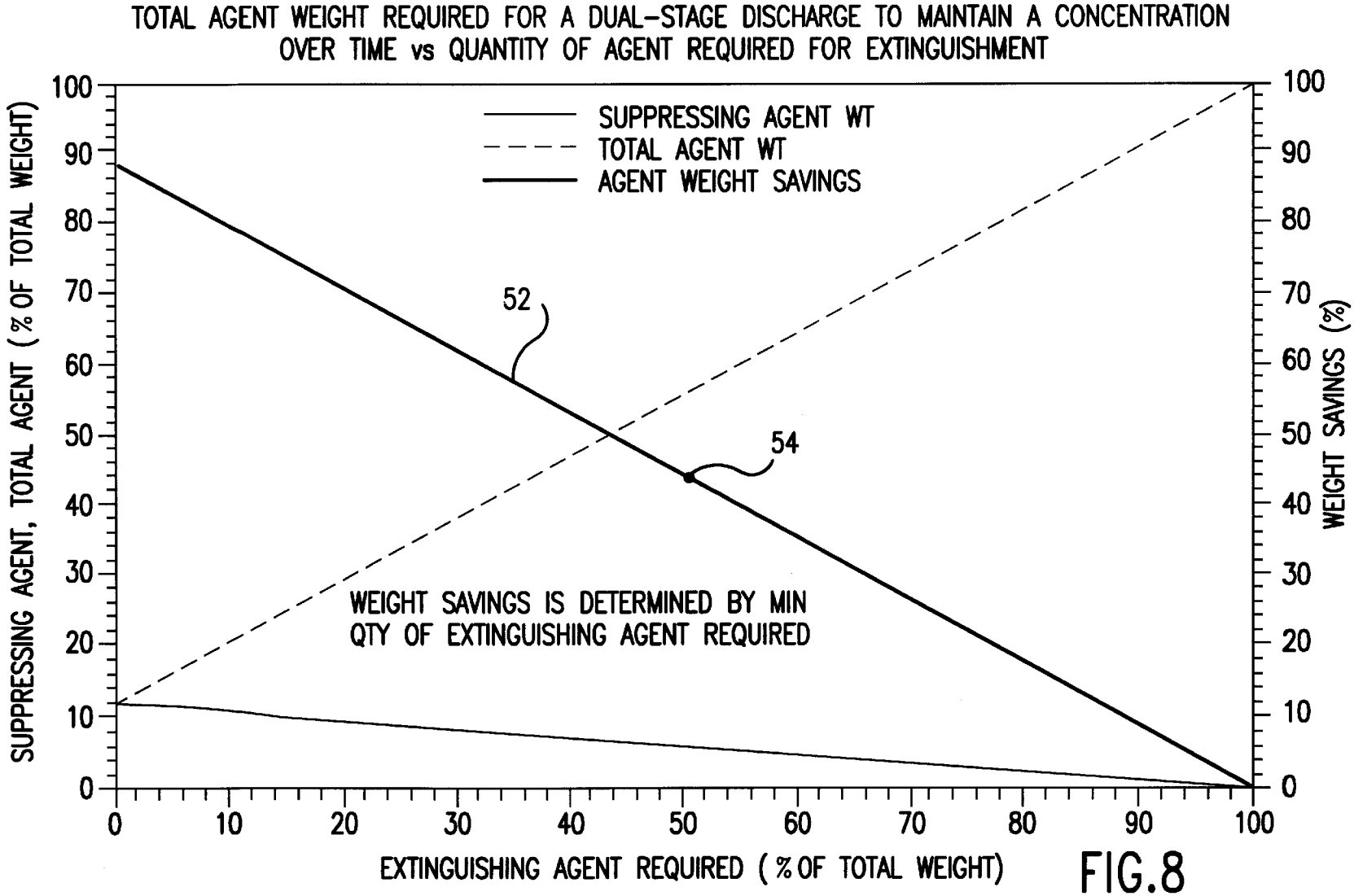
FIG. 8 illustrates the weight savings achieved by the method of the invention.

FIG. 8 further illustrates the potential inerting agent weight savings using a dual stage extinguisher system. Dependent on the type of fire and the burning medium, the percentage of total inerting agent required as an extinguishing agent can be determined. A lesser quantity of suppressing agent then constitutes the balance of the inerting agent weight. By extending a line from the "extinguishing agent required" axis to the agent weight savings 52 and then extending the line horizontally to the axis labeled "weight savings," the savings can be calculated.

As an example, if 50% of the weight of the inerting agent in a single stage extinguisher is required for extinguishing, in the dual stage extinguisher, only an additional 6% is required for suppression enabling, as illustrated at reference point 54, a weight savings of 44%.

The dual stage system of the invention is applicable to a pressurized Halon system as illustrated in FIG. 1. The system reduces the total amount of Halon required, lessening the environmental impact and extending the availability of Halon for aircraft fire systems and other applications.

Figure 9:
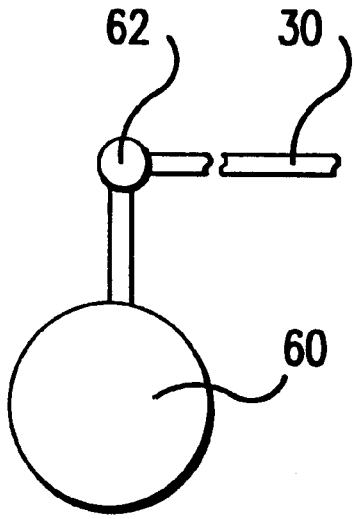
FIGS. 9–13 illustrate systems to deliver an inerting agent in accordance with the method of the invention.

The increased efficiency of the dual stage system of the invention, facilitates the use of other fire inerting agents, that while less effective than Halon, are safer for the environment. The inerting agent 28 may be replaced with other agents such as HFC-227 ($CF_3CHFCH_3$), HFC-125 ($CF_3CF_2H$), HFC-236, nitrogen or carbon dioxide. As illustrated in FIG. 9, a single pressurized cylinder 60 has a flow rate regulator 62 to provide the proper mass flow rate of inerting gas to the fire for both extinguishing and suppression.

Figure 10:
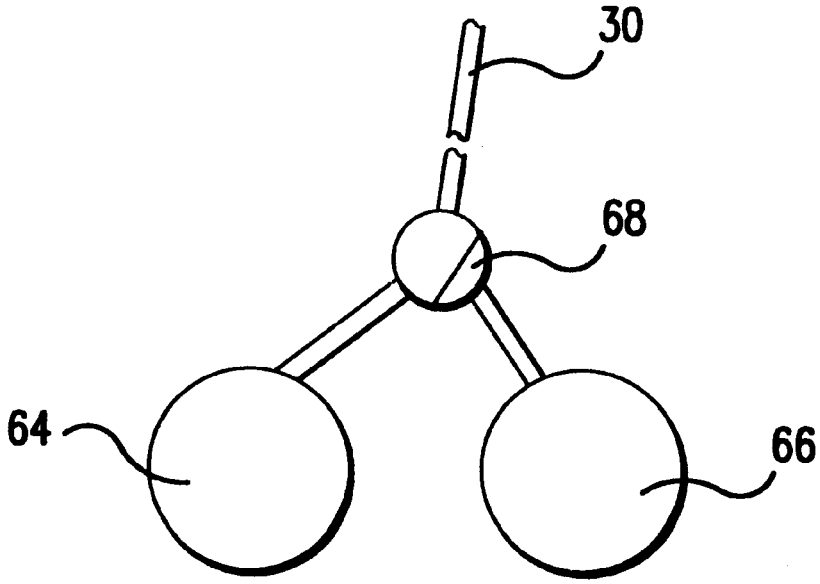

Alternatively, as shown in FIG. 10, the inerting agent is stored in a first vessel 64 in a volume and conduit system effective to provide a sufficient mass flow rate and gas concentration to extinguish the fire. A second vessel 66 contains either the same inerting agent or a different inerting agent in an amount and with conduit of a sufficient flow rate to provide effective inerting agent to suppress the fire. A baffle 68 controls the flow of the inerting agents to the conduit 30.

Figure 11:
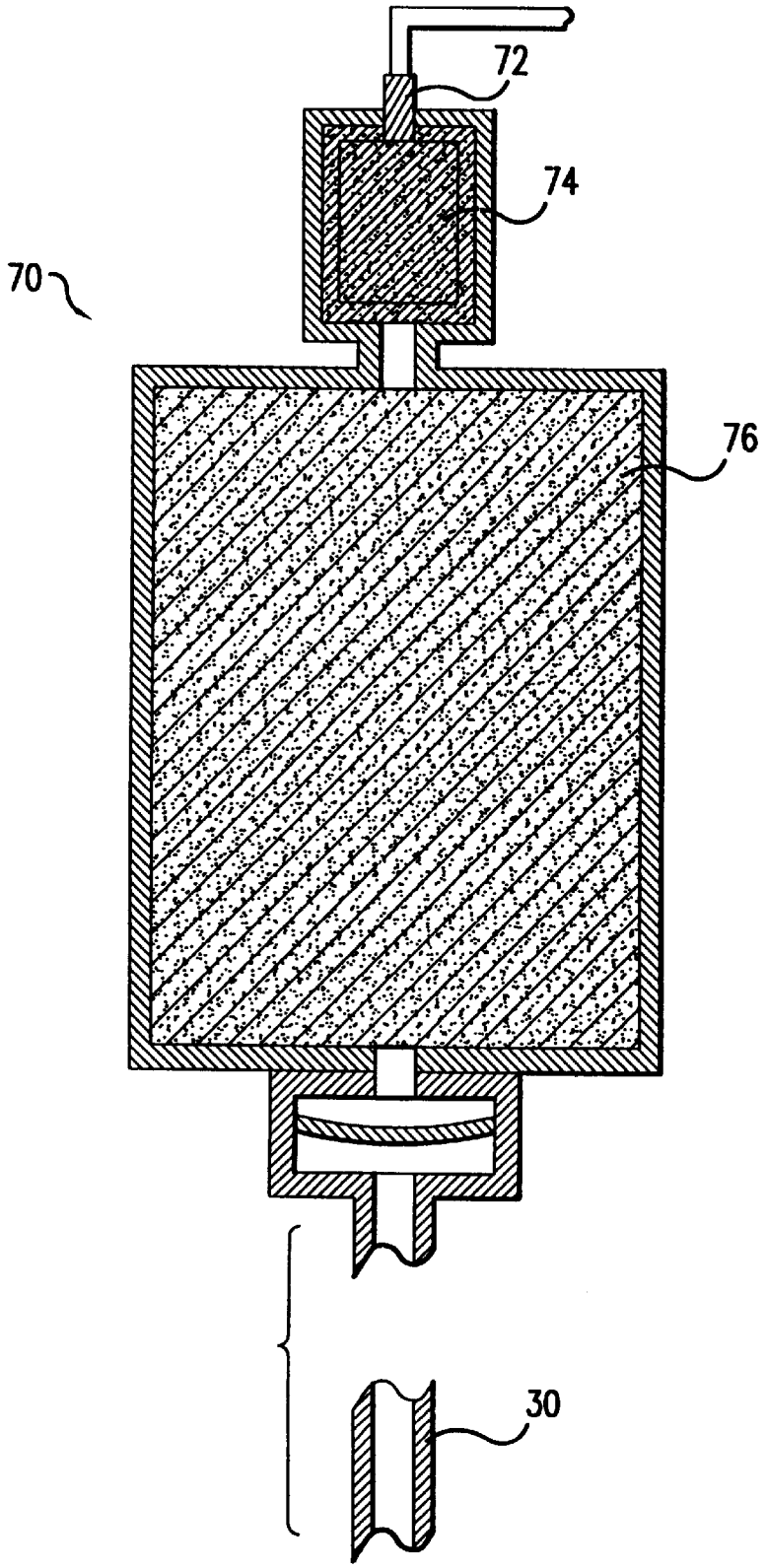

Fire suppressing gas generators, as known from U.S. Pat. No. 5,613,562 to Galbraith et al., that is incorporated by reference in its entirety herein, may also be utilized. As illustrated in FIG. 11, in the gas generator system 70, a squib 72 ignites a gas generating chemical mixture 74 that is either, then expelled onto the fire or, directed against a fire extinguishing powder 76 expelling the powder. Suitable fire extinguishing powders include magnesium carbonate, potassium bicarbonate, sodium bicarbonate and ammonium phosphate.

Figure 12:
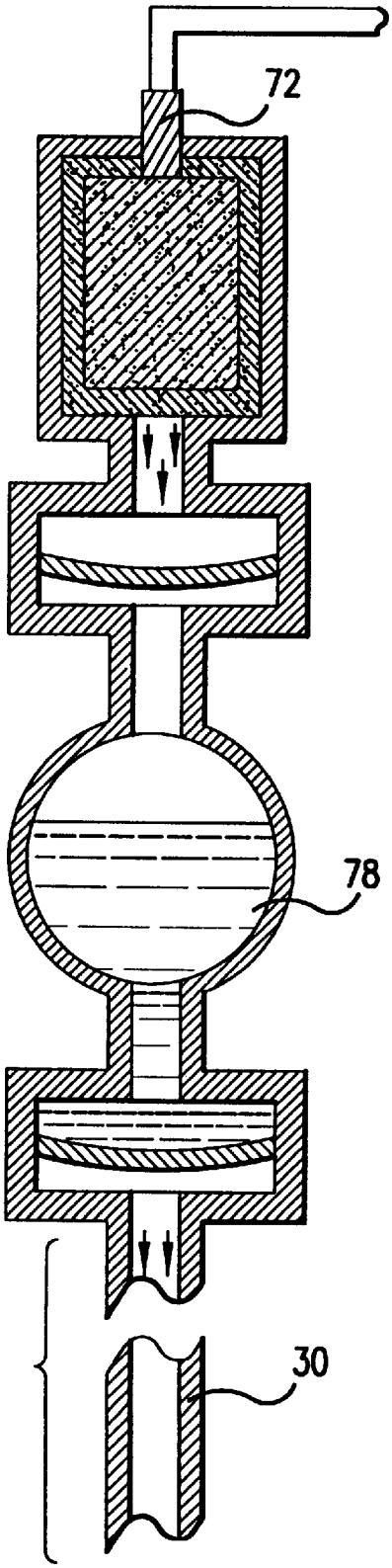

In yet another embodiment, as illustrated in FIG. 12, the gas generator delivers a gaseous stream to a fire inerting liquid 78 that is preferably a vaporizable liquid including fluorocarbons, molecules containing only a carbon-fluorine bond, and hydrogenated fluorocarbons molecules containing both carbon-hydrogen and carbon-fluorine bonds.

Figure 13:
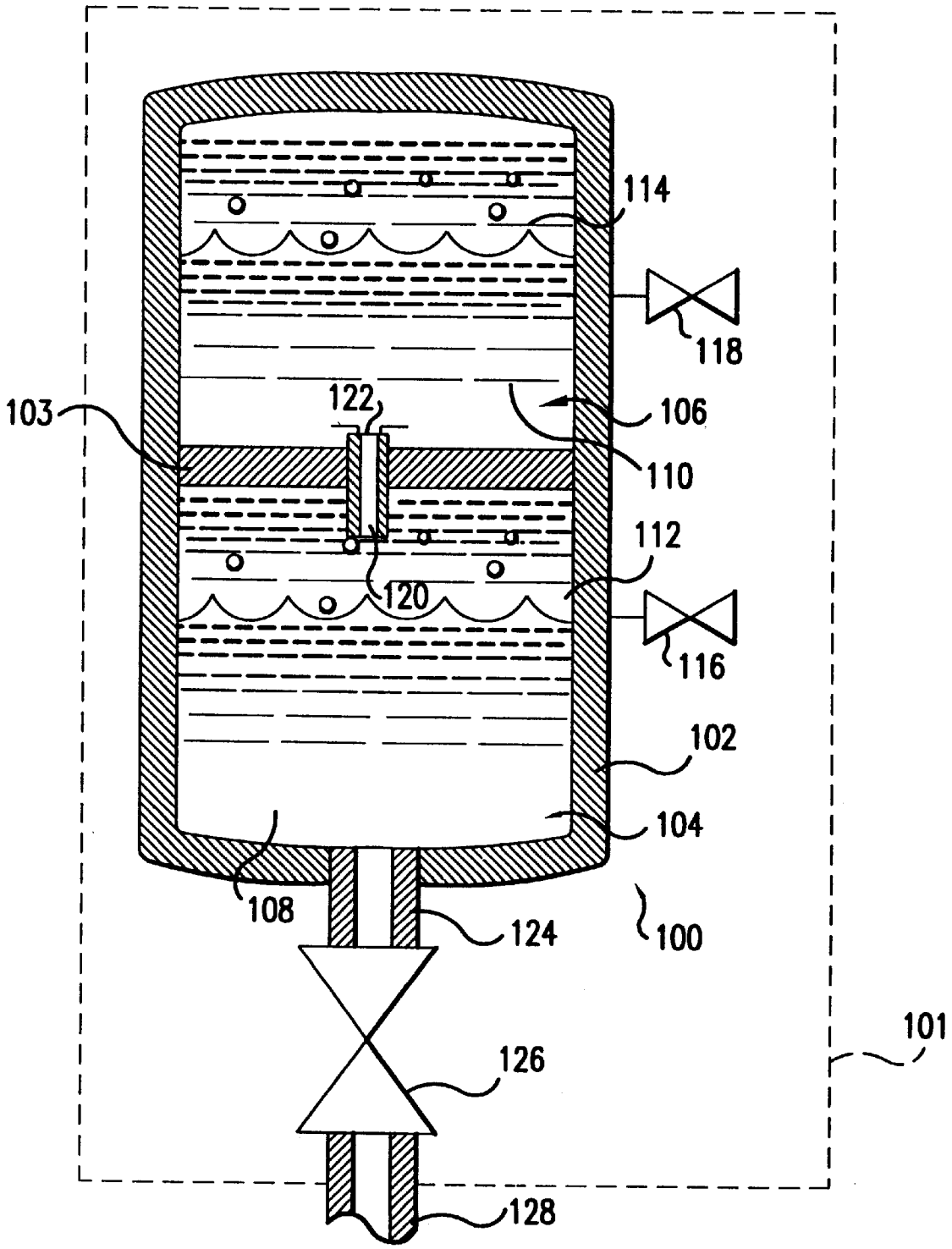

FIG. 13 shows an alternate extinguisher 100 in which the inerting agents are arranged in series in a single vessel 102. The extinguisher 100 may fit within a storage location 101 of an aircraft. In a retrofit situation, the location 101 may be dimensioned for a existing single-agent extinguisher to be replaced by the extinguisher 100. Specifically, the vessel 102 is divided by a wall 103 into first (downstream) and second (upstream) chambers 104 and 106, respectively. The downstream and upstream chambers contain first and second inerting agents 108 and 110, respectively, and first and second pressurants 112 and 114, respectively. The vessel has valved fill ports 116 and 118 in communication with the first and second chambers, respectively, for filling such chambers with their associated inerting agent and pressurant.

The wall 103 includes an aperture 120. The aperture 120 is normally closed such as by a valving element such as a burst disk 122. The aperture is openable responsive to a pressure difference between the upstream and downstream chambers 104 and 106. In particular, when the pressure in the upstream chamber exceeds that in the downstream chamber by at least a threshold amount, the burst disk opens (either permanently in the case of a frangible disk or non-permanently in the case of certain spring-loaded valves or the like). A discharge to conduit 124 extends from a discharge port in the vessel 102. A valve 126 is positioned between the discharge conduit 124 and a distribution conduit 128 which directs the inerting agents to the fire location as discussed below.

In the exemplary embodiment, the vessel 102 is oriented so that the upstream chamber 106 is above the downstream chamber 104, with the wall 103 extending horizontally. The first inerting agent 108 is selected for its usefulness in extinguishing the fire. The second inerting agent 110 is chosen for its usefulness in suppressing the fire and advantageously has no adverse chemical interaction with the first inerting agent. Exemplary agents are: HFC's (particularly those approved by the U.S. Environmental Protection Agency (EPA) under the Significant New Alternative Policy (SNAP), e.g., HFC-125, HFC-23, HFC-227ea and HFC-236fa); liquids (in particular water and water-based agents, e.g., water with a freezing point depressant); $CF_3I$; PFC's; and Halon 1301. Preferred pressurants may be compressed or liquified gases (e.g., compressed nitrogen gas). In the exemplary embodiment, the pressurants 112 and 114 comprise compressed nitrogen gas in respective headspaces of the downstream and upstream chambers above the associated liquid bodies of inerting agents 108 and 110. The pressurants 112 and 114 initially maintain the associated chambers at gage pressures in an exemplary range of between about 200 psi (1.4 MPa) and about 1000 psi (6.9 MPa).

In operation, the valve 126 which, for example, may be in the form of a solenoid-operated valve or a pyrovalve, is caused to open such as by a command from a human user or from an automated controller connected to a fire detection system. Once the valve 126 is open, the pressure of the first pressurant 112 expels the first inerting agent 108 from the vessel 102 through the conduits 124 and 128 to direct the inerting agent to the fire location. The system dimensions and geometry (in particular the cross-sectional areas of the conduits 124 and 128 and valve 126) and the amount and pressure of the pressurant 112 are selected to produce the desired extinguishing flow rate of the first inerting agent so that the concentration of the first inerting agent within the fire location quickly reaches the level required to extinguish the fire during an extinguishing interval.

As the pressurant 112 expands, expelling the inerting agent 108, the pressure within the downstream chamber 104 decreases accordingly. Such pressure eventually decreases to the point where it is below the pressure in the upstream chamber 106 by a threshold amount. When this occurs, the aperture 120 is opened such as by a bursting of the burst disk 122. The second pressurant 114 then drives the second inerting agent through the aperture 120 and into the downstream chamber 104. This helps drive the remaining first inerting agent 108 (if any is left) from the downstream chamber. The flow rate of the second inerting agent from the upstream chamber to the downstream chamber (and thus via conservation principles from the downstream chamber to the fire) is limited by the size of the aperture 120. Advantageously, the aperture 120 has a minimum cross-sectional area which is substantially smaller than the effective minimum cross-sectional area of the flow path of inerting agent from the downstream chamber to the fire. For example, the aperture 120 may have a minimum cross-sectional area of between about 2% and about 25% of the effective minimum cross-sectional area downstream of the downstream chamber. This difference in cross-sectional area, combined with any difference in the pressurization of the pressurant 114 relative to the pressurant 112 limits the flow rate of the second inerting agent to a rate which is advantageously just sufficient to maintain a desired suppression concentration of the inerting agents in the fire location. The effect is that the second inerting agent flows through aperture 120 between the chambers and is expelled from the vessel at a rate and for a time which are effective to suppress re-ignition of the fire during an interval whereafter the fire is unlikely to re-ignite in the absence of the inerting agent(s). When different agents are used as the first and second agents, the concentration of the first agent will typically decrease during the suppression stage as it is replaced by the second agent.

When stored under pressure, both inerting agents may be in liquid form as described above. However, an agent which is stored in liquid form may be delivered in gaseous form due to the pressure drop between the chamber in which the agent is stored and the ambient conditions at the point of delivery. In an exemplary embodiment, the first inerting agent 108 may be delivered substantially in liquid form while the second inerting agent 110 is delivered substantially in gaseous form. For example, the first inerting agent could consist essentially of water or a water-based agent while the second inerting agent consists essentially of the EPA SNAP approved HFC's identified above or their mixtures.

One key advantage of the system 100 is that it may be configured as a drop-in or minimal alteration replacement for existing Halon systems. The vessel 102 may be made substantially to fit within the envelope required by an existing single chamber Halon vessel. The invention thus allows a more efficient use of a less efficient agent to replace a less efficient use of the highly efficient Halon of a prior art system.

While the dual stage fire extinguisher of the invention has been described in terms of an engine nacelle, it is also effective to extinguish a fire in other confined areas. Thus, in addition to the illustrated wing nacelle, the invention may be applied to engine compartments which are partially or fully integrated into the aircraft fuselage and, beyond engine compartments, to areas such as cargo dry bays, personnel compartments of tanks and other armored or non-armored vehicles, ammunition storage compartments of tanks, ship holds and spacecraft.

Many of the design parameters of the system will be application-dependent. Influencing factors include: the volume of the region containing the fire; the expected type of fuel; the expected temperatures of potential re-ignition sources; the expected rate of dissipation of an accumulation of inerting agent (which may be influenced by factors such as the speed of a moving aircraft or other vehicle, and the degree of structural damage such as increased ventilation due to shrapnel holes, etc.); and the type(s) of inerting agent utilized.

It is apparent that there has been provided in accordance with this invention a method for suppressing a fire that fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A method for inerting a fire at a location, comprising the steps of:

a) providing a first chamber containing a first body of a first inerting agent and a second chamber containing a second body of a second inerting agent, the first and second bodies initially discrete;

b) delivering the first inerting agent along a flow path from the first chamber to said location at a first mass flow rate for a time effective to extinguish said fire; and c) delivering the second inerting agent from the second chamber through the first chamber and along said flow path to said location at a second mass flow rate for a time effective to prevent re-ignition of said fire.

2. The method as claimed in claim 1 further comprising:

providing a first pressurant in the first chamber and a second pressurant in the second chamber.

3. The method as claimed in claim 2 wherein the first inerting agent is delivered as a liquid and the second inerting agent is delivered as a gas.

4. The method as claimed in claim 3 wherein the first inerting agent is water-based and the second inerting agent is an HFC.

5. The method as claimed in claim 4 wherein the second inerting agent is selected from the group consisting of HFC-125, HFC-23, HFC-227ea, and HFC-236fa.

6. With an aircraft fire extinguishing/suppressing system for delivering inerting agent along a flow path from a storage location in the aircraft to a fire location in the aircraft, a method for rebuilding the system comprising the steps of:

removing a first vessel containing a single body of inerting agent from the storage location;

thereafter installing in the storage location a second vessel containing first and second discrete bodies of inerting agent respectively in first and second chambers within the second vessel and coupling the second vessel to a conduit so that the conduit, first chamber and second chamber are located in series so that upon actuation of the system with the second vessel installed inerting agent is sequentially delivered: from the first body in the first chamber along the flow path to the fire location; and then from the second body in the second chamber, through the first chamber, and along the flow path to the fire location.

7. The method as claimed in claim 6 wherein the effective amount of said single inerting agent in said single body is larger than a combined effective amount of inerting agent in said first and second bodies.

8. The method as claimed in claim 7 wherein throttling is provided between the first and second chambers effective to restrict flow of inerting agent from the second chamber to the first chamber so that upon actuation of the system with the second vessel installed, discharge of inerting agent occurs over a second interval of time which is longer than a first interval of time required for discharge of inerting agent with the first vessel installed.

9. The method as claimed in claim 6 wherein the first inerting agent is delivered as a liquid and the second inerting agent is delivered as a gas.

10. The method as claimed in claim 9 wherein the first inerting agent is water-based and the second inerting agent is an HFC.

11. The method as claimed in claim 9 wherein the second inerting agent is selected from the group consisting of HFC-125, HFC-23, HFC-227ea, and HFC-236fa.

12. An apparatus for extinguishing a fire and suppressing re-ignition thereof, comprising:

a first chamber for containing a first inerting agent;

a second chamber for containing a second inerting agent; and a common conduit to substantially sequentially direct the first inerting agent and the second inerting agent to a fire location such that the first inerting agent is introduced to the fire location during an interval effective to extinguish the fire and the second inerting agent is introduced to the fire location during an interval effective to suppress re-ignition of the fire, wherein the first chamber is defined by a downstream portion of a vessel and the second chamber is defined by an upstream portion of the vessel, the upstream portion separated from the downstream portion by a dividing wall spanning the vessel, the wall including an openable aperture for permitting flow of the second inerting agent from the second chamber into the first chamber responsive to an at least partial depletion of the first inerting agent from the first chamber.

13. The apparatus as claimed in claim 12 wherein said first inerting agent is the same chemical compound as said second inerting agent.

14. The apparatus of claim 12 further including a first pressurant within the first chamber and a second pressurant within the second chamber.

15. The apparatus of claim 14 wherein the aperture is initially sealed by a burst valve, which automatically opens when pressure in the second chamber exceeds pressure in the first chamber by a threshold amount.

16. The apparatus as claimed in claim 12 wherein said first inerting agent is a different chemical compound than said second inerting agent.

17. The apparatus as claimed in claim 12 wherein said first and second inerting agents are selected from the group consisting of HFC-125, HFC-23, HFC-227ea, and HFC-236fa.

18. An apparatus for extinguishing a fire and suppressing re-ignition thereof, comprising:

a first chamber for containing a first inerting agent;

a second chamber for containing a second inerting agent; and a common conduit extending downstream from the first chamber and coupled to the second chamber by the first chamber to substantially sequentially direct the first inerting agent and the second inerting agent to a fire location such that the first inerting agent is introduced to the fire location during an interval effective to extinguish the fire and the second inerting agent is introduced to the fire location during an interval effective to suppress re-ignition of the fire.

19. An apparatus for extinguishing a fire and suppressing re-ignition thereof, comprising:

a first chamber defined by a first vessel for containing a first inerting agent;

a second chamber defined by a second vessel for containing a second inerting agent;

a baffle coupled to said first vessel and said second vessel for controlling a flow rate of said first and second inerting agents; and a common conduit coupled to the baffle to substantially sequentially direct the first inerting agent and the second inerting agent to a fire location such that the first inerting agent is introduced to the fire location during an interval effective to extinguish the fire and the second inerting agent is introduced to the fire location during an interval effective to suppress reignition of the fire.

* * * * *